US007694754B2

(12) United States Patent
Dick

(10) Patent No.: US 7,694,754 B2
(45) Date of Patent: Apr. 13, 2010

(54) STABILIZED SEAL FOR ROCK BITS

(75) Inventor: Aaron J. Dick, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 34 days.

(21) Appl. No.: 11/838,361

(22) Filed: Aug. 14, 2007

(65) Prior Publication Data

US 2008/0035382 A1 Feb. 14, 2008

Related U.S. Application Data

(60) Provisional application No. 60/837,561, filed on Aug. 14, 2006.

(51) Int. Cl.
*E21B 10/00* (2006.01)
*F16J 15/34* (2006.01)
*F16J 15/32* (2006.01)

(52) U.S. Cl. ..... 175/371; 277/400; 277/574

(58) Field of Classification Search ..... 384/94; 175/371

See application file for complete search history.

(56) References Cited

U.S. PATENT DOCUMENTS 3,944,306 A 3/1976 Neilson
5,362,073 A * 11/1994 Upton et al. ..... 277/589
6,196,339 B1 3/2001 Portwood et al.
6,357,540 B1 3/2002 Page et al.
2003/0094766 A1 * 5/2003 Byrd ..... 277/549
2005/0056462 A1 3/2005 Burr
2005/0274550 A1 12/2005 Yu et al.
2006/0065445 A1 3/2006 Chellappa

FOREIGN PATENT DOCUMENTS

GB 2382091 A 5/2003

* cited by examiner

*Primary Examiner*—David J Bagnell
*Assistant Examiner*—Catherine Loikith
(74) *Attorney, Agent, or Firm*—Bracewell & Giuliani LLP

(57) ABSTRACT

An earth boring bit has a bit body having a depending bearing pin. A cone has a cavity rotatably mounted on the bearing pin. A seal groove is formed in the cavity of the cone. An elastomeric seal ring is located within the groove and forms a seal between a base of the groove and the bearing pin. The seal ring has two side surfaces, each spaced from one of the side walls of the groove by a clearance. Elastomeric protuberances protrude from each of the side surfaces of the seal ring for non-sealing contact with one of the side walls of the groove.

17 Claims, 2 Drawing Sheets

STABILIZED SEAL FOR ROCK BITS

CROSS-REFERENCE TO RELATED APPLICATION

This application claims priority to provisional patent application 60/837,561, filed Aug. 14, 2006.

FIELD OF THE INVENTION

This invention relates in general to rolling cone earth-boring bits, and in particular to a high aspect ratio elastomeric seal located between the cone and the bearing pin that has stabilizing protuberances on at least one side surface.

BACKGROUND OF THE INVENTION

A rolling cone earth boring bit has a body with a threaded end that attaches to a drill string. The body normally has three depending bearing pins, each supporting a cone rotatably mounted thereon. Each cone has cutting elements on its exterior for disintegrating the earth formation as the bit body is rotated. Each cone has a cavity that slides over one of the bearing pins. A lubricant reservoir supplies lubricant to the spaces between the cone cavity and bearing pin. Normally, the lubricant system also has a pressure compensator for equalizing the lubricant pressure with the pressure of the borehole drilling fluid on the exterior of the bit. A sealing arrangement located near the mouth of each cone seals the lubricant from the borehole fluids.

If the sealing arrangement begins to leak, the bit would soon fail and have to be retrieved. This could occur before the cutting structure on the cone has worn out, thus shortening the life of the bit. Because of the importance of having a durable sealing arrangement, many varieties have been used and proposed over the years. In one type, a seal groove is formed in the cone cavity near the mouth of the cone. The groove has a base and two parallel side walls. An elastomeric seal ring fits within the groove and seals between the base and the bearing pin.

The seal ring may be a type referred to as a high aspect ratio seal ring. A high aspect ratio seal ring has a radial dimension measured from its inner diameter to its outer diameter that is greater than its thickness, measured from one side surface to the other. The seal groove has a depth that is greater than its width. Sealing engagement occurs between the outer diameter of the seal ring and the groove base and between the inner diameter of the seal ring and the bearing pin. The side surfaces of the seal ring do not sealingly engage the side walls of the groove. Normally, the width of the groove is appreciably larger than the width of the seal ring so as to allow the seal ring to thermally expand during use.

A disadvantage of having clearances between the seal ring side surfaces and the groove side walls is that the seal ring may initially become misaligned or skewed relative to the groove. If so, the misalignment may cause a different contact pressure than desired between the seal ring and the seal groove and the bearing pin. The different contact pressure could result in seal failure.

SUMMARY

In this invention, a high aspect ratio elastomeric seal ring has at least one protuberance protruding from at least one of the side surfaces of the seal ring for contact with one of the side walls of the groove. The protuberances center the seal ring within the seal groove but do not seal. Rather, the protuberances are spaced so each side surface of the seal ring has a communication path between the outer diameter surface and the inner diameter surface, enabling communication of fluid between the outer diameter surface and the inner diameter surface while the protuberances are in contact with the side walls of the groove.

Each protuberance is elastomeric and integrally joined to one of the side surfaces of the seal ring. In one embodiment, each protuberance comprises a small, round bump that may be generally conical. In another embodiment, each protuberance comprises an arcuate ridge having a circumferential length less than 360 degrees.

Preferably some of the protuberances on each side surface are spaced farther from the seal groove base than others. In the examples shown, the protuberances on each side surface are located within two concentric rows, the protuberances within each row being spaced apart from each other.

DETAILED DESCRIPTION OF THE INVENTION

Figure 1:
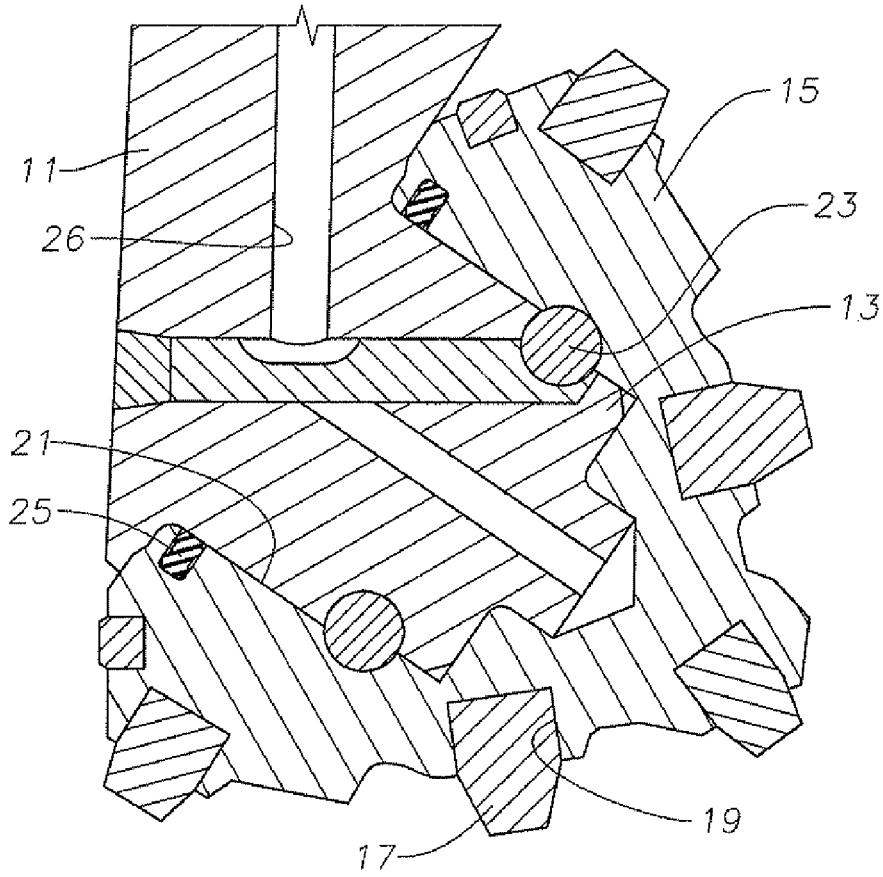
FIG. 1 is a partial sectional view of an earth-boring bit constructed in accordance with this invention.

Referring to FIG. 1, a bit has a bit body 11 that typically has three depending bit legs. A cylindrical bearing pin 13 depends from each bit leg of bit body 11. A cone 15 having a plurality of cutting elements 17 mounts rotatably on bearing pin 13. In this example, cutting elements 17 comprise tungsten carbide inserts inserted into mating holes 19. Alternately, cutting elements 17 could comprise teeth machined in the exterior surface of cone 15.

Cone 15 has a cavity with a cylindrical bearing surface 21 located therein. Bearing surface 21 may be formed integrally with cone 15, or it may comprise a sleeve secured within the cavity of cone 15, as by a shrink fit. Cone bearing surface 21 forms a journal bearing surface with bearing pin 13. A locking element 23, which comprises a plurality of balls in this example, is located in mating grooves on bearing pin 13 and in the cavity of cone 15. A seal ring 25 is located near the mouth of the cavity of cone 15. Seal ring 25 seals against bearing pin 13 near its junction with bit body 11. A sleeve (not shown) may optionally be located on bearing pin 13 where seal ring 25 seals, and if so, the sleeve is considered herein to be a part of bearing pin 13.

Lubricant passages 26 extend from a lubricant reservoir (not shown) to spaces between bearing pin 13 and cone bearing surface 21 for supplying lubricant that is sealed within the cone cavity by seal ring 25. The lubricant reservoir has a pressure compensator to reduce the pressure differential between the lubricant and the borehole drilling fluid on the exterior of the bit.

Figure 2:
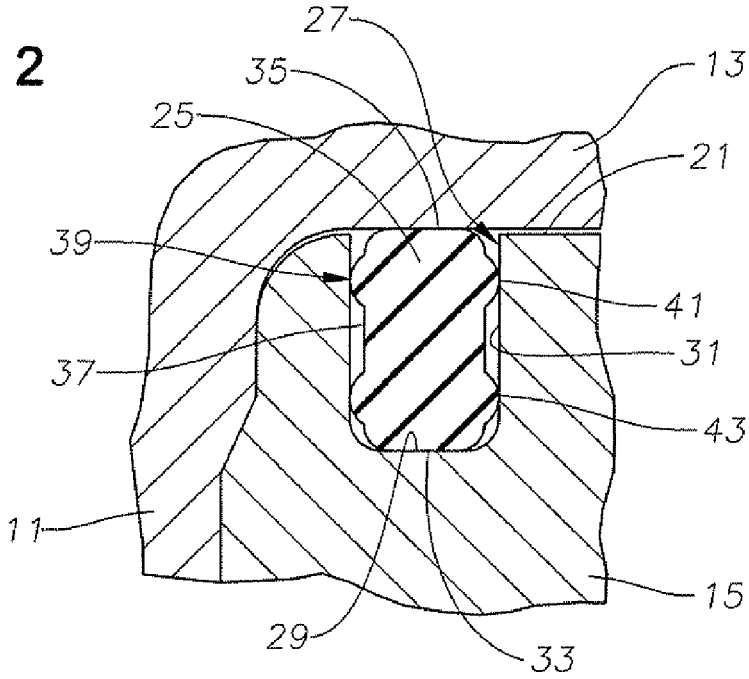
FIG. 2 is an enlarged sectional view of a lower portion of the bearing pin and cone of the earth-boring bit of FIG. 1.

Referring to FIG. 2, in this embodiment seal ring 25 is an elastomeric member located in a gland or groove 27 that is formed in the cavity of cone 15 near its mouth. Groove 27 has a cylindrical base 29 and two parallel side walls 31 that extend from base 29 perpendicular to the axis of bearing pin 13. Seal ring 25 has an outer diameter 33 that forms a seal with groove base 29 that is normally static. However, some slippage of seal ring 25 may occur during rotation with cone 15. Seal ring 25 has an inner diameter 35 that forms a dynamic or sliding sealing engagement with the cylindrical surface of bearing pin 13. In this embodiment, seal ring 25 has two side walls 37 that are generally flat and, parallel to groove side walls 31. Inner and outer diameters 35, 33 are rounded and could be of various shapes.

Seal ring 25 preferably has a high aspect ratio; that is, the radial extent between outer diameter 33 and inner diameter 35 is greater than the axial extent between side surfaces 37. The axial extent between the flat portions of side surfaces 37 is smaller than the axial width of seal groove 27 between groove side walls 31. When installed and deformed between bearing pin 13 and seal groove base 29, the flat portions of seal side surfaces 37 will be spaced inward from groove side walls 31 by clearances. At least one elastomeric protuberance 39 protrudes from one of the seal side surfaces 37. In this example, plurality of elastomeric protuberances 39 are located on and protrude from seal side surfaces 37. The axial width of seal ring 25 measured from a protuberance 39 on one side surface 37 to a protuberance 39 on the opposite side surface 37 is substantially the same as the axial width of groove 27, although it could be slightly greater or slightly less.

Figure 3:
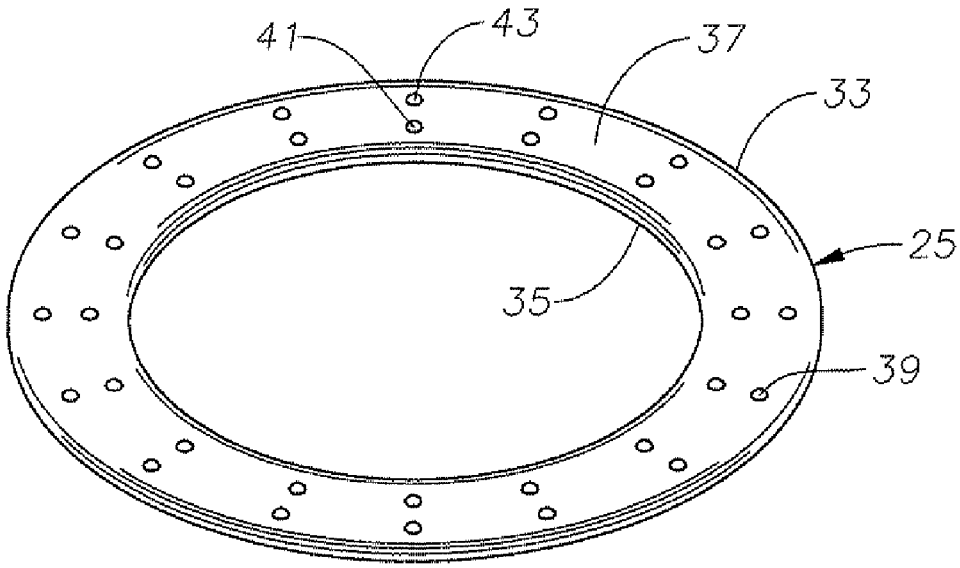
FIG. 3 is an isometric view of the seal employed with the earth-boring bit in FIGS. 1 and 2.

Some of the protuberances 39 on each side surface 37 are preferable closer to seal groove base 29 than others. In the examples shown, protuberances 39 are located in multiple circular rows, as shown in FIG. 3. An inner row 41 of protuberances 39 is located near inner diameter 35 and an outer row 43 of protuberances 39 is located near outer diameter 33. Additional rows could be employed, if desired. The shapes of protuberances 39 can vary. In the embodiment of FIG. 3, each protuberance 39 comprises a small, rounded conical bump spaced circumferentially apart from the other protuberances 39 in the same row. Protuberances 39 within each row 41 and 43 are circumferentially spaced apart from each other, providing a communication path for fluid between seal outer diameter 33 and inner diameter 35. Each protuberance 39 protrudes from seal side surface 37 a distance approximately equal to the clearance that exists between seal side surfaces 37 and groove side walls 31 when seal ring 25 is installed and centered within groove 27.

Protuberances 39 are preferably formed integrally with seal ring 25 and have the same chemical composition. The properties of protuberances 39, such as hardness and bulk modulus of elasticity, could be the same as or differ from other portions of seal ring 25.

During installation, protuberances 39 will normally contact groove side walls 31 and thus support seal ring 25 within groove 27 in a substantially aligned position. If identical protuberances 39 are located on each side, a plane passing through a mid point on seal inner diameter 35 and a mid point on seal outer diameter 33 will be substantially equidistant between groove side walls 31 and parallel to groove side walls 31. Even though seal ring 25 is deformed by the contact pressure between bearing pin 13 and groove base 29, clearances will preferably still exist between the flat portions of seal side surfaces 37 and groove side walls 31. If protuberances 39 are located only one side surface 37, they will force the opposite side of seal ring 25 into contact with the opposite groove side wall 31. A plane passing through the mid point on seal inner and outer diameters 35, 33 would be still parallel to groove side walls 31, but offset to one side.

When drilling of the bit begins, seal ring 25 will prevent drilling mud from entering the bearing spaces between bearing pin 13 and cone bearing surface 21, and it will seal lubricant within the bearing spaces by the sealing engagement of seal inner diameter 35 and outer diameter 33. Protuberances 39 do not serve any sealing function and cannot seal lubricant within the bearing spaces because they are circumferentially spaced apart from each other. Seal ring 25 typically rotates with cone 15 and slides against bearing pin 13. Protuberances 39 on the outer side surface 37 will be immersed in drilling fluid. Protuberances 39 on the inner side surface 37 will be immersed in lubricant.

Heat is generated in the vicinity of seal ring 25 because of the friction between the cone bearing surface 21 and bearing pin 13 and also the friction between seal inner diameter 35 and bearing pin 13. In addition, the portion of the well being drilled may be at a high temperature due to the geologic formation. The heat may cause swelling of seal ring 25. If so, the increased volume of seal ring 25 is accommodated by the clearances between seal side surfaces 37 and groove side walls 31. The two rows 41, 43 of protuberances 39 keep seal ring 25 from becoming skewed within groove 27, which could result in a reduction in contact pressures at the outer and inner diameters 33, 35.

Figure 4:
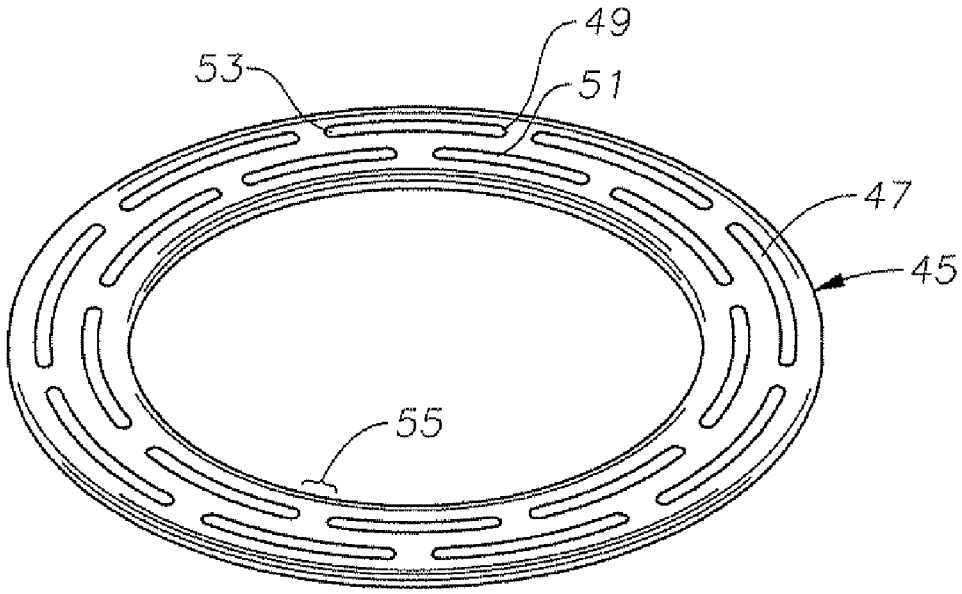
FIG. 4 is an isometric view of an alternate embodiment of the seal of FIG. 3.

In the alternate embodiment of FIG. 4, seal ring 45 has protuberances that comprise elongated, concentric arcuate ribs or ridges 47. Each ridge 47 extends circumferentially a selected distance that in this example is about 35 degrees. Each ridge 47 has a width that is much smaller that its circumferential length. Ridges 47 are located in an outer row 49 and an inner row 51, with outer row 49 being closer to the outer diameter of seal ring 45 than inner row 51. Each ridge 47 has opposite ends 53, each of which is spaced by a gap 55 from an end 53 of adjacent ridge 47 in the same row. In this example, each gap 55 of inner row 51 is spaced radially inward from a mid point of one of the ridges 47 of outer row 49. Each gap 55 of outer row 49 is spaced radially outward from a mid point of one of the ridges 47 of inner row 51. Gaps 55 prevent ridges 47 from sealing and provide communication paths for fluid from the inner diameter to the outer diameter of seal ring 45. Although FIG. 4 shows only one side of seal ring 45, the opposite side may have an identical set of ridges 47.

The invention has significant advantages. The protuberances on the seal ring provide alignment and centering of the seal ring within the seal groove. Maintaining alignment reduces the chance for the seal ring to become skewed within the seal groove.

While the invention has been shown in only one of its forms, it should be apparent to those skilled in the art that it is not so limited but is susceptible to various changes without departing from the scope of the invention.

The invention claimed is:

1. An earth boring bit, comprising:

a bit body having a depending bearing pin;

a cone having a cavity rotatably mounted on the bearing pin;

a seal groove formed in the cavity of the cone, the seal groove having two side walls and a base;

an elastomeric seal ring having an inner diameter surface, an outer diameter surface and inboard and outboard side surfaces, the inboard side surface being in contact with lubricant in the cavity of the cone, the outboard side surface adapted to be in contact with drilling fluid, the outer diameter surface being in sealing engagement with the base of the groove, the inner diameter surface protruding from the groove and in sealing engagement with the bearing pin;

at least one protuberance protruding from at least one of the side surfaces of the seal ring for contact with one of the side walls of the groove;

wherein the side surface of the seal ring containing the protuberance has a communication path between the outer diameter surface and the inner diameter surface, enabling communication of fluid between the outer diameter surface and the inner diameter surface on the side surface containing the protuberance; and wherein there are no other sealing members between the cone and the bearing pin farther inboard of the inboard side surface of the seal ring.

2. The bit according to claim 1, wherein the seal ring comprises the only seal member between the cone and the bearing pin for sealing the lubricant in the cavity.

3. An earth boring bit, comprising:

a bit body having a depending bearing pin;

a cone having a cavity rotatably mounted on the bearing pin;

a seal groove formed in the cavity of the cone, the seal groove having two side walls and a base;

an elastomeric seal ring having an inner diameter surface, an outer diameter surface and two side surfaces, the outer diameter surface being in sealing engagement with the base of the groove, the inner diameter surface protruding from the groove and in sealing engagement with the bearing pin;

at least one protuberance protruding from at least one of the side surfaces of the seal ring for contact with one of the side walls of the groove;

wherein said at least one protuberance extends circumferentially less than 360 degrees; and wherein the protuberance comprises an arcuate ridge having a circumferential length less than 360 degrees.

4. The bit according to claim 3, wherein said at least one protuberance comprises a plurality of protuberances on said at least one of the side surfaces, the protuberances being spaced apart from each other so as to avoid blocking fluid communication between the inner diameter surface and the outer diameter surface.

5. The bit according to claim 3, wherein said at least one protuberance comprises a plurality of protuberances within a concentric row on said at least one of the side surfaces, the protuberances within the row being spaced apart from each other.

6. The bit according to claim 3, wherein said at least one protuberance comprises a plurality of protuberances on said at least one of the side surfaces, with at least one of the plurality of protuberances being located farther from the inner diameter surface than at least one other of the plurality of protuberances.

7. The bit according to claim 3, wherein said at least one protuberance comprises an inner row and an outer row of protuberances on said at least one of the side surfaces, the inner row being closer to the inner diameter surface than the outer row, the inner and outer rows being concentric, the protuberances within each row being circumferentially spaced apart from each other.

8. An earth boring bit, comprising:

a bit body having a depending bearing pin;

a cone having a cavity rotatably mounted on the bearing pin;

a seal groove formed in the cavity of the cone, the seal groove having two side walls and a base, the base having a width that is less than a depth of each side wall;

an elastomeric seal ring located within the groove and forming a seal between the base of the groove and the bearing pin, the seal ring having two side surfaces, each spaced from one of the side walls of the groove by a clearance;

a plurality of elastomeric protuberances protruding from each of the side surfaces of the seal ring for non-sealing contact with one of the side walls of the groove; and wherein each protuberance comprises an arcuate ridge having a circumferential length less than 360 degrees, each of the ridges having a lesser thickness than the length.

9. The bit according to claim 8, wherein the arcuate ridges on each side surface of the seal ring are spaced from each other to define a communication path between the base of the groove and the bearing pin.

10. The bit according to claim 8, wherein the arcuate ridges on each side surface are located within at least one concentric row on each side surface, the protuberances within each row being spaced apart from each other.

11. The bit according to claim 8, wherein the arcuate ridges on each side surface are located within an inner row and an outer row, the inner row being closer to the base of the groove than the outer row, the inner and outer rows being concentric, the protuberances within each row being circumferentially spaced apart from each other.

12. The bit according to claim 8, wherein each arcuate ridge protrudes from one of the side surfaces an amount substantially equal to the clearance between each side surface and each side wall of the groove.

13. The bit according to claim 8, wherein a thickness of the seal ring, measured from an extremity of the protuberances on one of the side surface to an extremity of the protuberance on the other of the side surfaces, is substantially the same as the width of the base of the groove.

14. An earth boring bit, comprising:

a bit body having a depending bearing pin;

a cone having a cavity rotatably mounted on the bearing pin;

a seal groove formed in the cavity of the cone, the seal groove having two side walls and a base, the base having a width that is less than a depth of each side wall;

an elastomeric seal ring located within the groove and forming a seal between the base of the groove and the bearing pin, the seal ring having two side surfaces, each side surface comprising a substantially flat portion that is parallel to and spaced from one of the side walls of the groove; and the seal ring having a plurality of elastomeric protuberances protruding from each of the side surfaces for contact with one of the side walls of the groove, some of the protuberances on each of the side surfaces being located farther from the base of the groove than others, each of the protuberances being spaced from other of the protuberances on the same side surface and having a circumferential extent that is less than 360 degrees; and the seal ring comprises the only seal member between the bearing pin and the cone.

15. The bit according to claim 14, wherein each protuberance comprises an arcuate ridge.

16. The bit according to claim 14, wherein the protuberances on each side surface are located within at least one concentric row on each side surface.

17. The bit according to claim 14, wherein the protuberances on each side surface are located within an inner row and an outer row, the inner row being closer to the base of the groove than the outer row, the inner and outer rows being concentric.

* * * * *